US007347906B1

(12) United States Patent
Guirguis

(10) Patent No.: US 7,347,906 B1
(45) Date of Patent: Mar. 25, 2008

(54) VARIABLE OUTPUT AND DIAL-A-YIELD EXPLOSIVE CHARGES

(75) Inventor: Raafat H. Guirguis, Fairfax, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 284 days.

(21) Appl. No.: 10/975,123

(22) Filed: Oct. 25, 2004

Related U.S. Application Data

(63) Continuation-in-part of application No. 10/401,890, filed on Mar. 31, 2003, now Pat. No. 6,846,372.

(51) Int. Cl.
*C06B 45/12* (2006.01)
*F42B 12/20* (2006.01)

(52) U.S. Cl. ..... 149/14; 102/491; 102/506; 102/389

(58) Field of Classification Search ..... 102/506, 102/514, 501, 478, 491, 473, 389, 517; 89/1.11, 89/1.1; 149/2, 14
See application file for complete search history.

(56) References Cited

U.S. PATENT DOCUMENTS 4,619,201 A * 10/1986 Romer et al. ..... 102/283
4,658,727 A 4/1987 Wilhelm et al. ..... 102/494
5,229,542 A 7/1993 Bryan et al. ..... 102/491
5,538,795 A 7/1996 Barbee, Jr. et al. ..... 428/420
5,996,501 A 12/1999 Spencer et al. ..... 102/286
6,105,505 A 8/2000 Jones ..... 102/364
6,352,029 B1 * 3/2002 Guirguis et al. ..... 102/286

* cited by examiner

*Primary Examiner*—James S Bergin
(74) *Attorney, Agent, or Firm*—Fredric J. Zimmerman

(57) ABSTRACT

The invention, as embodied herein, comprises a variable yield warhead comprising an inner core of cylindrically-shaped, explosive material surrounded by an outer annulus of a different explosive material. The inner core explosive material has a heat of combustion comprising about 16 kcal/cc or higher and the outer annulus of explosive material has a heat of detonation comprising about 2.1 kcal/cc or higher. A warhead casing surrounds the outer annulus of material. The warhead has a dual initiation system. The first initiation system comprises a detonation cord that extends substantially through the inner core of explosive material and has an initiator at the tope side. The second initiation system comprises a booster explosive that contacts the bottom side of the outer annulus of explosive material and an initiator proximate to the booster.

6 Claims, 8 Drawing Sheets

VARIABLE OUTPUT AND DIAL-A-YIELD EXPLOSIVE CHARGES

STATEMENT REGARDING PRIORITY

This application is a continuation-in-part of application Ser. No. 10/401,890, filed on Mar. 31, 2003 now U.S. Pat. No. 6,846,372 and said application is hereby incorporated by reference.

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

This invention relates in general to explosive charges, more particularly to explosive charges wherein the explosive charge yield can be adjusted on demand to various degrees, and most particularly to explosive charges wherein the explosive charge can optimally perform in various missions aimed at defeating air, surface, and shallow underground/underwater targets.

2. Description of the Related Art

Explosives are normally designed to provide good performance for a specific application. For example, PBXN-110, composed of 88% HMX and 12% polymeric binder, is designed to fragment a warhead's metal case and drive the fragments at high velocity, whereas PBXN-109, composed of 64% RDX, 20% aluminum, and 16% binder, is designed for internal blast applications. Other explosives have been designed to work well for underwater/underground applications such as explosive PBXN-111 composed of 20% RDX, 43% AP, 25% aluminum, and 12% binder. However, none of these explosives can optimally perform in all three missions.

Moreover, current warheads are designed to provide one, and only one, outcome after successfully initiating the explosive, and that is full-yield, which is often undesirable when unwanted collateral damage is a possibility, for example, when friendly troops or innocent civilians are in proximity.

Therefore, it is desired to provide an explosive charge and warhead design that is capable of performing optimally in multiple missions and provide the option of adjusting on demand the yield.

SUMMARY OF THE INVENTION

The invention proposed herein comprises an explosive charge and warhead design that allows a user to adjust, on demand, the yield of the warhead depending upon the selection of a number of initiation schemes. The explosive charge and warhead design of the present invention allows a user to provide good performance for fragmentation, internal blast, and underwater/underground scenarios from the same explosive charge/warhead.

Accordingly, it is an object of this invention to provide an explosive charge/warhead design that is capable of variable outputs.

It is a further object of this invention to provide an explosive charge/warhead design that allows the user to adjust the yield on demand to various degrees.

It is yet a further object of this invention to provide an explosive charge/warhead design that simultaneously provides good performance for fragmentation, internal blast, and underwater/underground mission scenarios.

This invention meets these and other objectives by providing a warhead/explosive charge design comprising an inner core of cylindrically-shaped, high heat of combustion explosive material capable of generating large amounts of heat when burnt, surrounded by an outer annulus of a different, high heat of detonation explosive material capable of releasing gases and energy quickly in order to drive fragments at high velocity and/or create strong air blasts. A warhead casing surrounds the outer annulus of material. The warhead has a dual initiation system. The first initiation system comprises a detonation cord that extends substantially through a central region of the inner core of explosive material and has a detonator at the tope side. The second initiation system comprises a booster explosive that contacts the bottom side of the outer annulus of explosive material and a detonator proximate to the booster.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF PREFERRED EMBODIMENTS

The invention, as embodied herein, comprises a combination of a new explosive charge and warhead design that is capable of variable outputs and allows the user the option of adjusting the yield on demand, and that can optimally perform in multiple missions. Several different embodiments of the present invention ensure that when the yield is reduced, all the components of the warhead are still eventually burned.

As used within this application, these terms are defined to mean the following. Shock sensitive means that the material will initiate if subjected to about 5 kbars of shock or greater. Shock insensitive means that the material will not initiate if subjected to about 25 kbars of shock or less. Heat sensitive means that the material will ignite and burn vigorously at normal, sea-level atmospheric pressures (1 atm.) when subjected to temperatures of about 600 degrees centigrade or smaller temperatures. Heat insensitive means that a material will not ignite and burn vigorously at normal atmospheric pressures unless subjected to temperatures of about 1200 degrees centigrade or greater. A weak shock means a shock of 10 kbars or less and a strong shock means a shock of about 30 kbars or greater.

Figure 1:
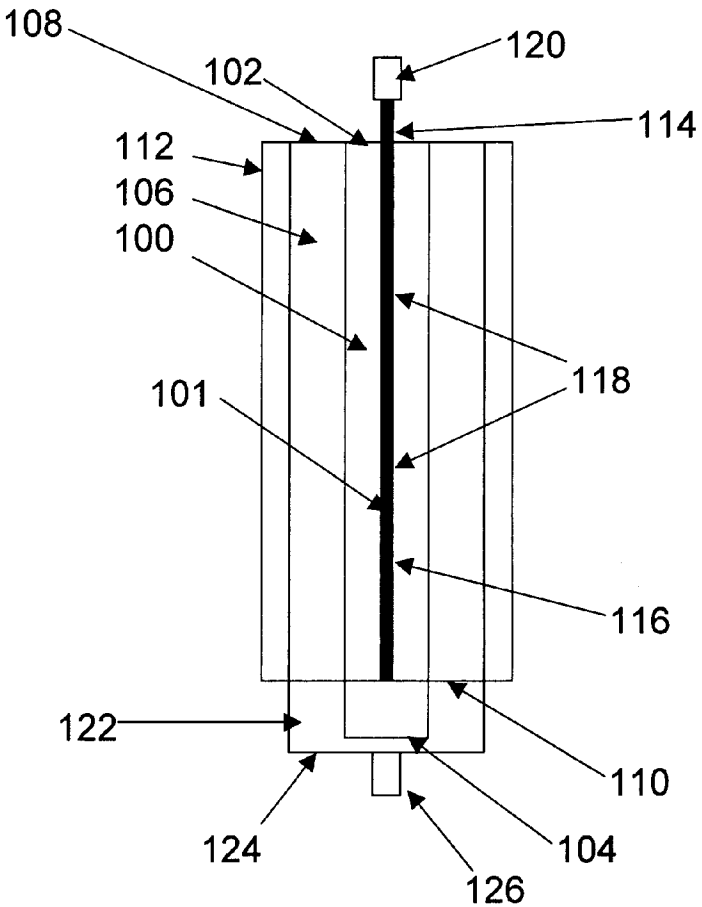
FIG. 1 is a cut-away view of one embodiment of the invention.

Referring to FIG. 1, the invention comprises a warhead having an inner core of material 100. The inner core of material 100 is generally cylindrical in shape, having top 102 and bottom 104 sides. In general, the inner core of material 100 is a formulation having a heat of combustion comprising about 16 kcal/cc or higher and producing a detonation pressure when initiated of about 10 kbar or lower. This type of material provides a strong internal blast when after initiation it combines with the oxygen in the surrounding atmospheric air and burns. The inner core of material 100 has a central region 101 which is substantially along the axis of the inner core of material 100. The inner core of material 100 is surrounded by an outer annulus of material 106. The outer annulus of material 106 also has top 108 and bottom 110 sides, respective of the top 102 and bottom 104 sides of the inner core of material 100. In general, the outer annulus of material 106 is a high explosive formulation having a heat of detonation of 2.1 kcal/cc or higher and producing a detonation pressure when initiated of about 270 kbar or higher, in order to drive fragments at high velocity. Also, the outer annulus of material 106 has a heat of combustion of about 5 kcal/cc or higher to supplement the heat generated by the inner core in internal blast applications. The outer annulus of material 106 is surrounded by a warhead casing 112.

The invention uses a dual initiation system. A first initiation system 114 comprises a first initiating explosive 116, a good example of 116 being a detonation cord, extending substantially through the central region 101, aligned with the axis 118 of the inner core of material 100, through the top 102 side and toward the bottom 104 side. The first initiation system 114 includes a detonator 120 to initiate the first initiating explosive 116 located at the top side 102. A second initiation system 122 comprises a booster explosive 124 contacting the bottom side 110 of the outer annulus of material 106 and a detonator 126 to initiate the booster explosive 124.

The inner core of material 100 should provide for a good internal type blast when initiated in the system described above. As depicted by the cited low detonation pressure of 10 kbars or lower, the inner core of material 100 will not normally be an explosive material or will be a very weak explosive material. Preferably, the inner core of material 100 comprises from about 60% or greater by volume of metal particles, from about 5% to about 10% by volume of what is known in the art as a high explosive and from about 10% to about 25% by volume of a binder. Any inert polymeric binder known in the energetic arts, such as an HTPB binder, may be used by one skilled in the art. A high explosive, as used herein, is defined as an explosive formulation having a heat of detonation of 2.1 kcal/cc or higher and producing a detonation pressure when initiated of about 270 kbar or higher. Examples of such high explosives include ingredients selected from the group of HMX, RDX, CL-20, or a combination thereof, in a polymeric inert binder, such as HTPB, or an energetic binder, such as TNT. The preferred metal particles comprise aluminum particles. Depending upon the mission, either fine, coarse, or a combination thereof of particle sizes may be selected by one skilled in the art.

The outer annulus of material 106 is a high explosive. Preferably, along with the above described heat of detonation and detonation pressure. Preferably, the outer annulus of material 106 will comprise a density of about 1.67 g/cc or higher, a critical diameter of about 0.25 inches or smaller, and a Gurney constant of about 2.70 km/s at a 19 mm radial expansion from a one inch cylinder test. The main role of the outer annulus of material 106 within the present invention is to drive fragments at high velocity, but also have a heat of combustion of about 5 kcal/cc or higher in order to supplement the heat generated by the inner core in internal blast applications. Preferred embodiments of the outer annulus of material 106 include materials comprising more than 60% by volume of an explosive ingredient selected from the group of HMX, RDX, CL-20, or combinations thereof. A good example of outer annulus of material 106 is PBXN-110 (88% HMX and 12% of a polymeric binder).

For the above described dual initiation system, the preferred first initiating explosive 116 is a detonation cord (such as an SX-2 detonation cord). The booster explosive 124 may be selected by one skilled in the art and, preferably is Pentolite.

Figure 2:
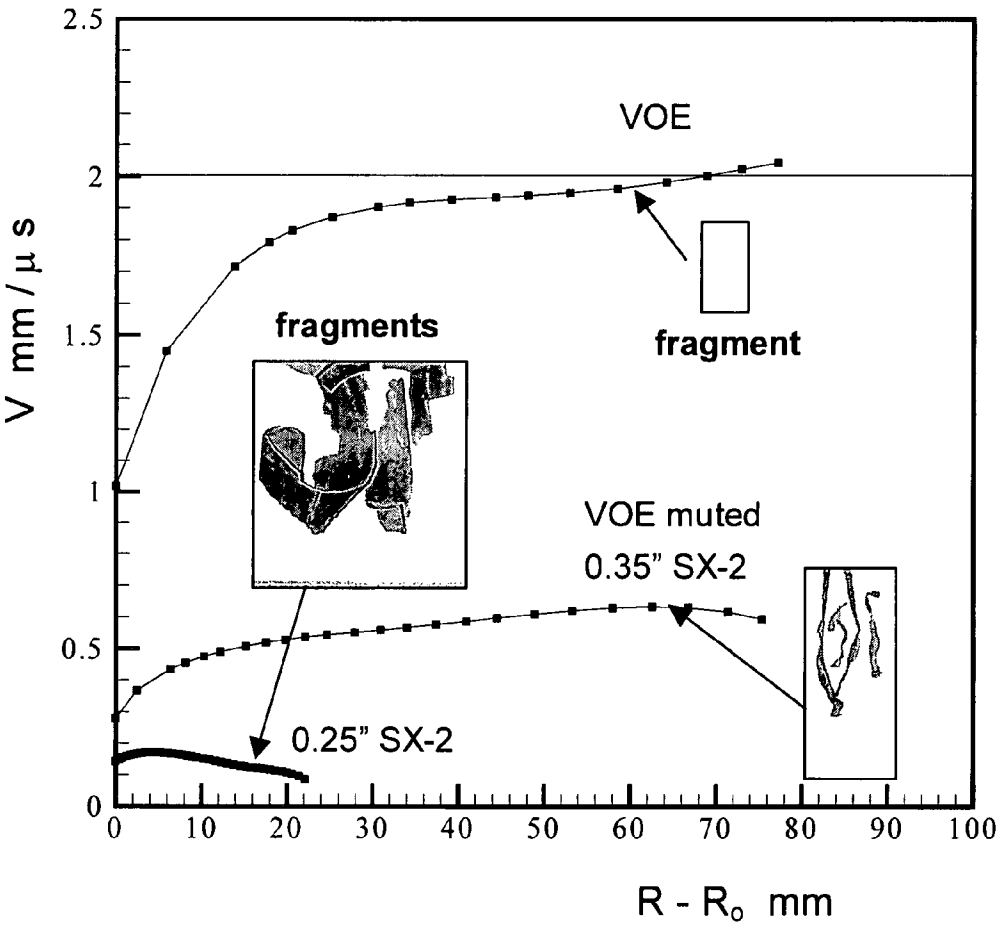
FIG. 2 is a graphical representation of the expansion velocity of the invention of FIG. 1 used in different yield modes.

FIG. 2 shows experimental results from an embodiment of the above described invention that employs PBXN-110 as the outer annulus of material 106, aluminum particles in a binder as the inner core material 100, an annealed copper warhead case 112, a pentolite booster 124, and an SX-2 detonation cord as the first initiating explosive 116. The expansion velocity before rupture of the case 112 is shown in FIG. 2. Two vastly different degrees of yield and different rupture patterns (fragments size and shape illustrated in inserts in figure) were achieved depending on which initiation system was selected. In the full-yield mode, when the pentolite booster 124 was initiated, the fragments velocity, about 2 km/s, closely approximates the performance of warheads completely filled with PBXN-110, known for its high fragment velocity (about 2.1 km/s), and the resulting quasi-static over-pressure matched that produced by a warhead completely filled with PBXN-109, known for its good internal blast performance. In the muted-output mode, when a 0.25" SX-2 detonation cord 116, loaded to 223 RDX grains per foot, was used for initiation, the fragments velocity was reduced by 90% to 200 m/s, but the over-pressure was also severely diminished. The shock induced in the outer annulus material 106 was weakened to avoid detonation, but it was also too weak to properly ignite it. Large chunks of unreacted PBXN-110 were recovered. When a 0.35" cord loaded to 485 grains per foot was detonated instead, the fragments velocity was only reduced by 70% to 600 m/s.

By definition, a variable output explosive charge can produce two, and only two fragment velocities—high velocity in the full-yield mode, when in the embodiment shown in FIG. 1, detonator 126 is fired, and a much lower velocity in the muted output mode, when detonator 120 is fired instead. In contrast, an explosive charge capable of "dialing a yield" means the warhead is capable of producing the whole spectrum of fragment velocities between these two extremes. This is accomplished with the same warhead design shown in FIG. 1 by firing both detonators 120 and 126, but sequentially—detonator 120 first, then after a short delay period, detonator 126. The velocity of the resulting metal fragments from the metal case 102 will depend on the time delay before detonator 126 is fired, the longer the delay, the smaller the velocity. If both are fired simultaneously, we get the maximum possible fragment velocity from the warhead. Moreover, in the embodiment shown in FIG. 1, the detonators 120 and 126 are located on opposite end of the explosive charge. But they can also be located on the same side, provided the center of booster 124 is hollowed out to allow initiation of the detonation cord 116 without initiating the booster 124.

Whether the present invention is used to produce the highest possible quasi-static pressure in internal blast applications or the largest possible bubble cavity in underground or underwater applications, it is important to ensure that when the yield is intentionally reduced/dialed down to avoid unwanted collateral damage, all the components of the warhead eventually burn. There are two specific embodiments of the present invention that ensure complete burning of all components.

Referring to FIGS. 3 and 3A-3C, one preferred embodiment of the invention that ensures complete burn of all components employs a reactively induced fragmentation explosive formulation is shown in FIGS. 3 and 3A-3C. This embodiment comprises an inner core of material 320, preferably comprising aluminum and a binder, and around it an outer annulus of material 328 comprising fragments 300 of a shock-insensitive explosive formulation, these fragments being held together in one embodiment, FIG. 3A, by a back-bone matrix of a relatively shock-sensitive explosive formulation 302, and a metal case 330 surrounding the composition 328. Within the inner core of material 320 a central region 321 contains a detonation cord 322. Two detonators 324, 325 are included at opposite ends of the explosive charge. One, 325, in contact with the first initiator explosive 322, preferably a detonation cord. And the second, 324, in contact with the booster/initiator material 326, placed, in turn, in contact with the outer annulus 328. If the fragments 300 comprise a shock insensitive explosive material such as PBXN 110, as described above, the following warhead applications may be obtained. If initiation point 324 is fired, the booster material 326 initiates a detonation throughout all the components in the composition 328, resulting in high velocity metal fragments from the case 330. If initiation point 325 is fired, instead, the weak shock generated by the detonation cord 322 will not be enough to initiate a detonation wave in the composition 328, but it will ignite the shock-sensitive back-bone matrix 302, which will separate the explosive fragments 300 and start their surface burning. It will also fracture the metal case 330, thus allowing the decomposition products of 300 and 302 to escape, but the velocity of the resulting metal fragments, from the metal case 330, will be minimal. If both detonators 324 and 325 are fired, but sequentially, detonator 325 first, then detonator 324, the velocity of the resulting metal fragments from the metal case 330 will depend on the time delay before detonator 324 is fired, the longer the delay, the smaller the velocity. If both are fired simultaneously, we get the maximum possible fragment velocity the warhead is capable of.

Figure 3:
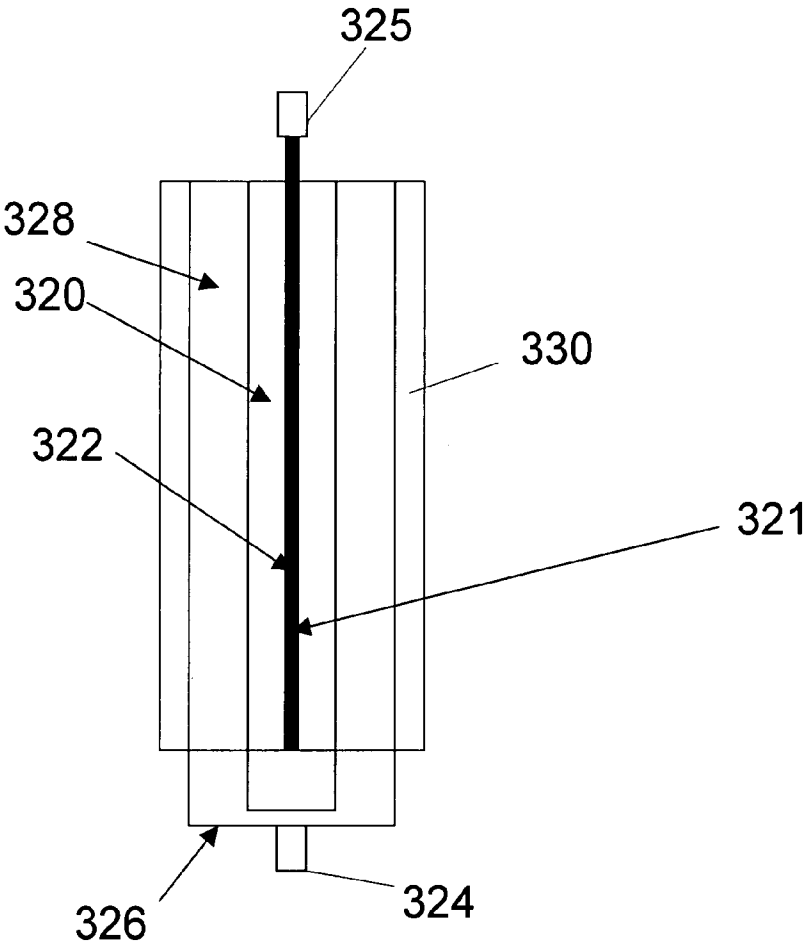
FIG. 3 is an embodiment of the invention using a reactively induced fragmentation explosive formulation.

In the embodiment shown in FIG. 3, the detonators 324 and 325 are located on opposite end of the explosive charge. But they can also be located on the same side, provided the center of booster 326 is hollowed out to allow initiation of the detonation cord 322 without initiating the booster 326.

For the embodiment described above, the outer annulus explosive material 328 comprises a plurality of energetic, macroscopic fragments 300 that are held together by a back-bone matrix or base material 302. These fragments are each a complete individual energetic formulation comprising at least two different components selected from the group of explosive particles, fuel, oxidizer, and binder, and a base material, comprising an explosive formulation, to hold the plurality of fragments together. The space between the fragments 300 is uniformly filled with the base material 302. In certain embodiments of the invention, such as illustrated in FIG. 3B and FIG. 3C, a coating 304 may be applied to the fragments 300. The coating 304 may be shock sensitive and heat insensitive or heat sensitive and shock insensitive, depending on the application. For example, referring to FIG. 3C, illustrating an explosive made by pressing, there is very little space between the fragments 300 for the binding material 302, so the fragments are coated with a relatively-thick layer of a shock-sensitive energetic material 304.

The fragments 300, are macroscopic in nature, each comprising many particles of different chemistry. This means that the fragments 300 comprise complete composite explosive ingredients, which may include energetic materials such as, fuel and oxidizer particles, and a binder holding these particles together into a fragment 300. While the size of the fragments 300 may be selected by one skilled in the art to meet different requirements, typical fragments 300 will be about 2 mm in diameter in size or larger. The fragments 300 will be shock insensitive, meaning that a weak shock will not initiate the fragments 300. The fragments 300 may be heat sensitive or heat insensitive depending upon the output of the composition as desired and discussed further below. While many energetic materials may be used for the fragments 300, certain explosive materials are preferred for particular embodiments of the invention. One preferred material is PBXN 110, which is made up of HMX and HTPB binder. Other examples of explosive materials that can be used for the fragments 300 include ammonium perchlorate, aluminum particles, and a polymeric binder matrix; RDX (cyclotrimethylene trinitramine), aluminum particles, and a binder; or nitrocellulose, hafnium, and a binder. In certain embodiments of the invention, it is desired that the fragments 300 are made of a propellant which produces an acid when it burns. For example, a propellant containing ammonium perchlorate produces HCl when it burns. Another example would be fine copper powder seeded with a small fraction of RDX and pressed in a binder. A final example would be a porous material impregnated with liquid halogens and sealed in an encapsulating passive layer. Finally, in another embodiment of the invention, the fragments 300 comprise a reactive material, such as a mixture of aluminum and Teflon® (polytetraflouroethylene).

The fragments 300 may be manufactured using many known processing techniques. For example, PBXN-110 may be normally cast, and then fragmented to the desired size using a process that will not significantly sensitize the fragments 300 (causing them to become shock sensitive). One method would be to extrude the PBXN-110 into rods and chop the rods into the desired lengths. This is a process similar to that used to manufacture gun propellants. The fragments 300 would then be cured to complete their processing.

The base material 302 will normally be either an explosive material that is shock sensitive or a substantially inert material, such as a binder, one preferred binder being wax, in which case the fragments 300 have to be coated with a thick layer 304 of a shock sensitive material. The selection is dependent upon the desired output of the composition as further discussed below. If an inert material is used, normally the amount of base material 302 will be less than if an explosive material is selected. The configuration of the composition when an inert material is selected for the base material 302, as illustrated in FIG. 3C, would normally be the case when the fragments 300 are pressed and the base material 302 comprises less than 10 percent by weight of the composition, more preferably about 3 percent to about 5 percent, merely being present to hold the pressed fragments 300 into position. In this embodiment, very little space exists between the fragments 300. The fragments 300 are then coated with a relatively thick layer of a relatively shock sensitive material 304, one preferred example being PBXN-301, composed of PETN and rubber.

Figure 3A:
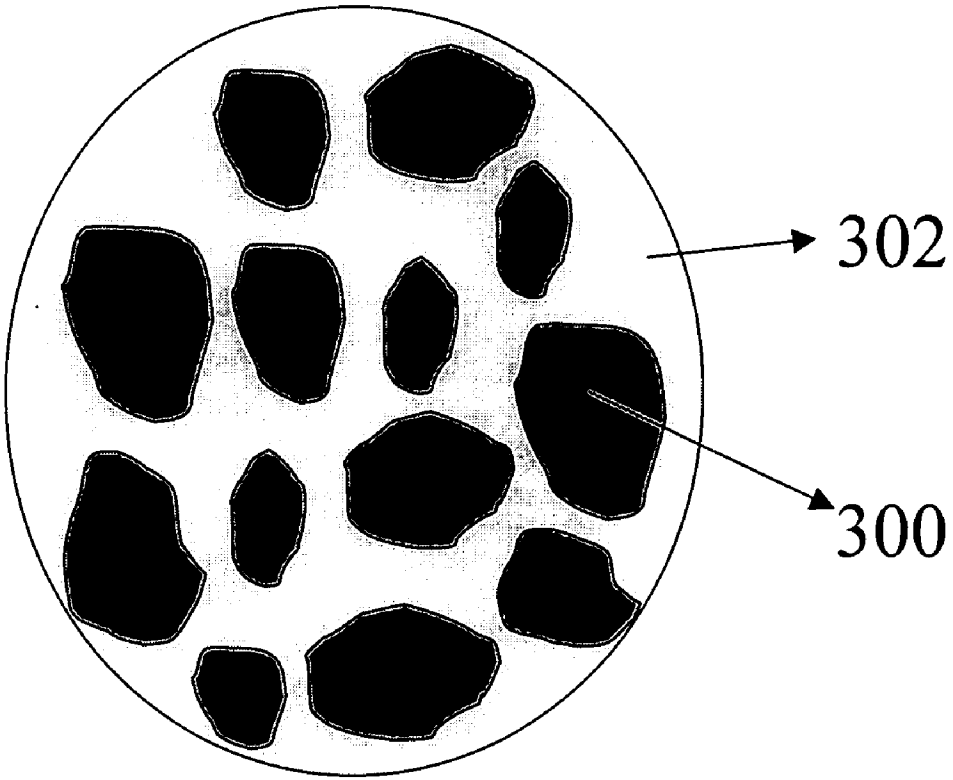
FIGS. 3A-3C are embodiments of a reactively induced fragmentation explosive used in the embodiment of the invention shown in FIG. 3.
Figure 3B:
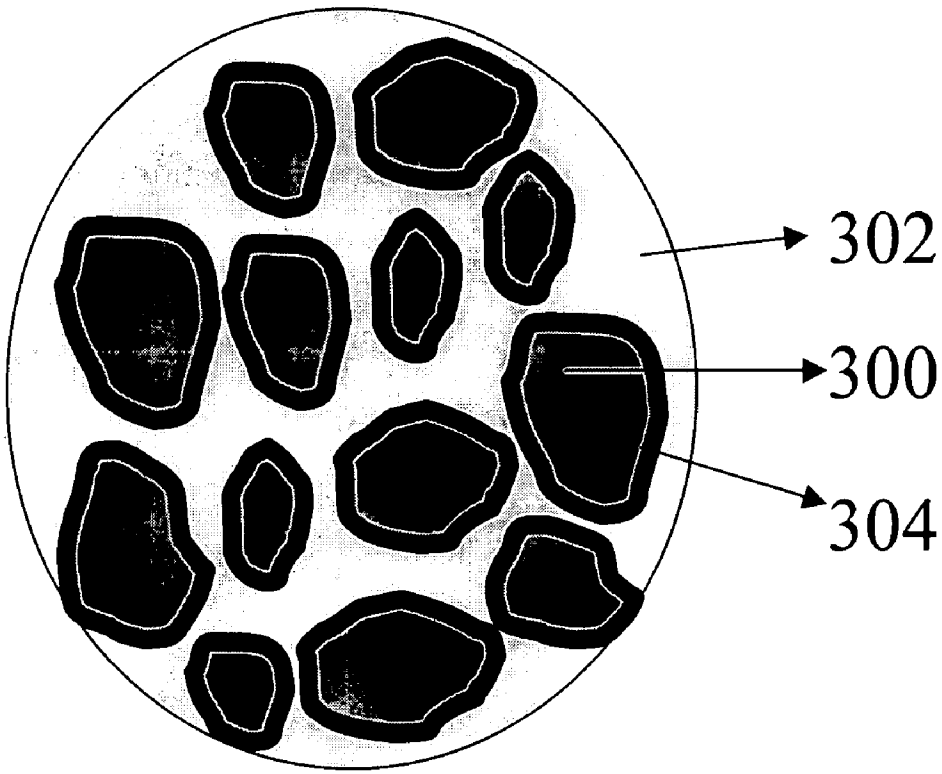
Figure 3C:
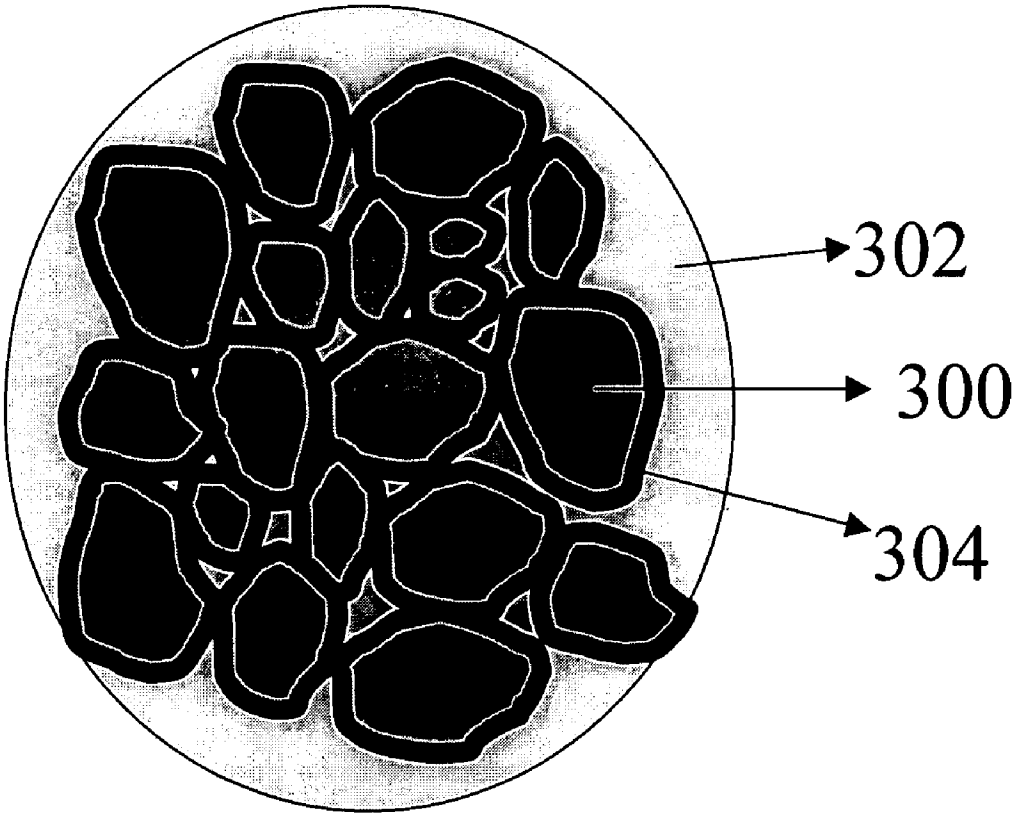

If an explosive material is selected for the base material 302, normally from about 20 to about 30 percent by weight of base material 302 will be present, as illustrated in FIG. 3A and FIG. 3B. The explosive is normally shock sensitive and one preferred example is Pentolite, composed of PETN and TNT, and manufactured by melt casting techniques. Another example is PBXN301, comprised of PETN particles in a polymeric binder, and manufactured by cure casting techniques, whereby PETN is first mixed with the plasticized binder then the curative added for cross linking.

If the detonation products of Pentolite are not hot enough to reliably start the surface of the PBXN-110 fragments burning, a coating 304 of nitrocellulose or a double-base gun propellant, which are easily ignited when exposed to hot gases, is added, as illustrated in FIG. 3B.

In general, currently known manufacturing techniques may be used to incorporate the fragments 300 into the base material 302. For example, instead of pressing, after the curing of the fragments 300 is complete, they are dispersed into a mixture of PETN and a binder, then, the curative for the binder may be added. This will result in the fragments 300 being dispersed throughout the base material 302.

The coating 304 may provide two separate functions, and, depending upon the function required, may also be selected by one skilled in the art. First, if fragments 300 are heat sensitive, the coating 304 may be shock sensitive and heat insensitive. This type of coating 304 will ignite when subjected to a weak shock, which, in turn, makes the shock insensitive, but heat sensitive fragment 300 burn, but not initiate. An example is PBXN-301. Second, the coating 304, may be shock insensitive, but heat sensitive to begin the burning process around the fragments 300. This type of coating 304 will not ignite when subjected a weak shock (similar to the fragment 300), but will begin the burning process around the fragment 300. An example is nitrocellulose used as a gun propellant.

In the embodiment of the reactively induced fragmentation explosive formulation illustrated in FIG. 3B, the base material 302 also includes an explosive material that is more shock sensitive than the fragments 300. However, the fragments are not heat sensitive enough for their surface to be reliably ignited by the hot decomposition products of the base material. Therefore, a heat sensitive, but shock insensitive explosive material 304 is used to coat the fragments 300 to ensure ignition.

Thus, a weak shock results in the energetic fragments 300 being simultaneously separated and ignited, but not detonated. However, if detonator 324 is initiated resulting in detonation of booster 326 a strong shock would sweeps through the outer annulus 328, it would result in ignition of the bulk of the fragments 300, thus initiating a detonation wave if the individual fragment's 300 composition is commensurate with an explosive's. Therefore, the formulation's output can be varied depending upon the stimulus provided.

Figure 4:
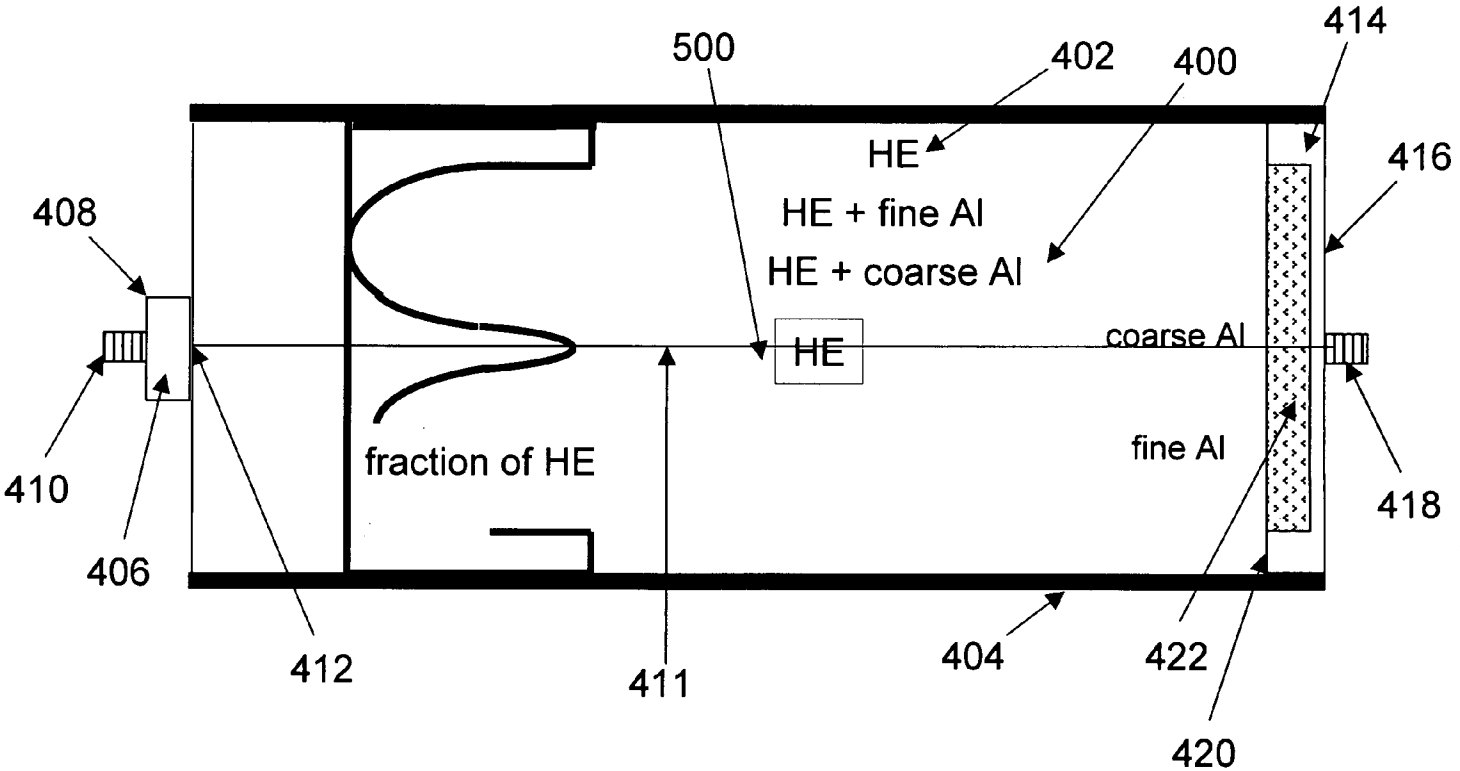
FIG. 4 is an embodiment of the invention using a radially graded explosive formulation.
Figure 5:
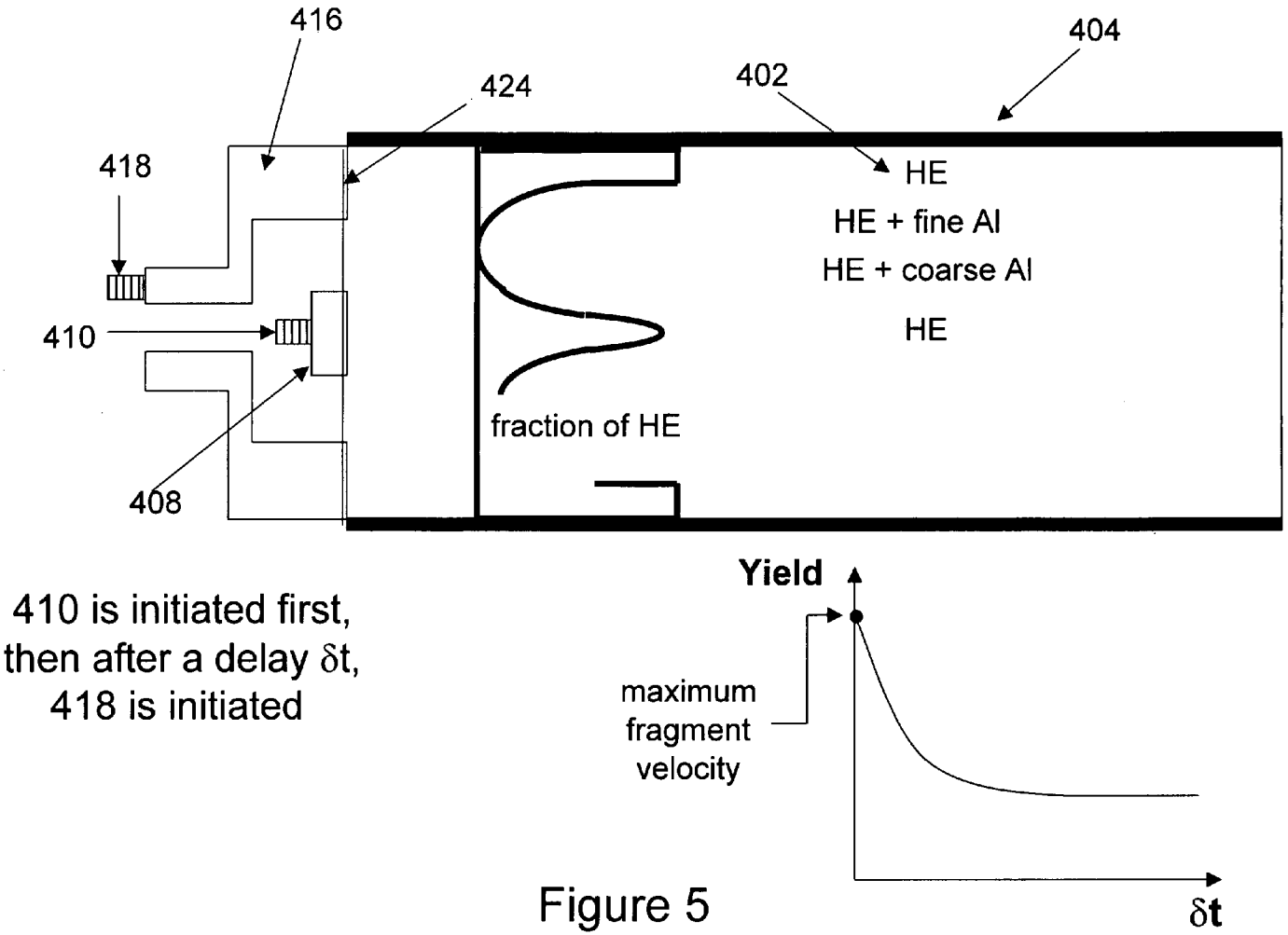
FIG. 5 is an embodiment of the invention using a radially graded explosive formulation and a modified booster/detonator configuration.

Referring to FIGS. 4 and 5, another embodiment of the present invention that ensures complete burning of all components is a radially graded explosive charge. Graded explosive formulations are described in U.S. Pat. No. 6,352,029, which is incorporated by reference herein. Rather than just two separate formulations and a detonation cord as shown in the embodiment of the invention in FIG. 1, the embodiments shown in FIGS. 4 and 5 depict a warhead in which the change in composition along the radius, from one component to the next is gradual. The central region 500 and that at the annulus outer edge 402, underneath the metal case 404, are high explosive formulations capable of autonomously propagating a detonation wave, but they are not necessarily the same composition. The formulation at the outer annulus edge 402 is needed to fragment the metal case 404 and drive the metal fragments at high velocity, thus should be a high explosive having a heat of detonation of 2.1 kcal/cc or higher and capable of producing when properly initiated detonation pressures of 270 kbar or higher as well as a Gurney constant of about 2.70 km/s or higher at a 19 mm radial expansion from a one-inch cylinder test. A high heat of combustion is not as important for outer annulus edge formulation 402, so 5 kcal/cc or higher is sufficient. A good example of a formulation fulfilling these requirements is PBXN-110 containing 88% HMX by weight. The central region formulation 500, replacing the detonation cord in the embodiments discussed above, can be less energetic, as long as it can propagate a detonation wave and as long as it generates hot detonation products capable of burning the metal fuel and other energetic ingredients in the inner core region. Good examples are formulations comprising significant fractions of PETN, RDX, or HMX in a polymeric inert binder.

The inner core formulation 400 in the region between 402 and 500 should have a high heat of combustion from about 16 kcal/cc or higher and producing a detonation pressure when initiated of about 10 kbar or lower to avoid initiating the outer annulus edge 402 when only central region formulation 500 is initiated. This is usually accomplished by formulations comprising a significant fraction of metal fuels, such as aluminum. As depicted in FIG. 4 and FIG. 5 the change in the radial direction from the outer edge formulation 402 to the inner core formulation 400 is gradual, same for the change from inner core formulation 400 to the central region formulation 500. The explosive charge in the warhead is radially-graded in order to ensure successful transition of ignition from inner to outer layers, hence complete burning of all the components when only the central region formulation 500 is initiated in order to dial down the yield.

As with the other embodiments of the invention noted above, a dual initiation system is used. A first initiation system 406, comprising a booster explosive 408, located proximate to an axis 411 of the central region of material 500 is shown. Booster explosives 408 are sensitive energetic materials having a small critical diameter, such as pentolite, but they are not necessarily as powerful as the outer annulus edge material 402. A detonator 410 in contact with booster explosive 408 is located on a top side 412 of the central region formulation 500. A second initiation system 414 includes a second booster explosive 416 contacting the outer annulus edge of material 402 and a detonator 418 to initiate the second booster explosive 416.

Exemplary examples of the constituents follow. The outer annulus edge of material 402 comprises more than 60% by volume of an explosive ingredient selected from the group of HMX, RDX, CL-20, or combinations thereof. The inner core of material 400, near the central region 500, comprises from about 60% or greater by volume of metal particles, from about 5% to about 10% by volume of an ingredient selected from the group of HMX, RDX, CL-20, or a combination thereof, and from about 10% to about 25% by volume of a binder. The central region material 500 comprises more than 60% by volume of an explosive ingredient selected from the group of PETN, RDX, CL-20, or combinations thereof. Both booster explosives 408 and 416 are Pentolite composed of 50% by weight PETN and 50% TNT.

The embodiment of the invention shown in FIG. 4 includes the second booster explosive 416 having a position on the bottom side 420 of the outer annulus edge of material 402 and further includes an absorbing material 422 located between the axial end of the graded inner core 400 and the second booster explosive 416. The absorbing material 422 ensures that the detonation resulting from initiation of the first booster explosive 408 does not result in initiation of the second booster explosive 416 and may be selected by one skilled in the art. One example of an absorbing material 422 is porous aluminum.

The embodiment of the invention shown in FIG. 5 shows the second booster explosive 416 located on the top side 424 of the outer annulus edge of material 402, in which case the absorbing material 422 is not needed. The center of booster 416 is hollowed out to allow access to detonator 410 and to avoid the initiation of booster 416 when detonator 410 is fired.

In the embodiments shown in FIG. 4 and FIG. 5, if both detonators 410 and 418 are fired, but sequentially, detonator 410 first, then detonator 418, the velocity of the resulting metal fragments from the metal case 404 will depend on the time delay before detonator 418 is fired. As illustrated in the insert in FIG. 5, the longer the delay, the smaller the velocity of the metal fragments. If both are fired simultaneously, the maximum possible fragment velocity from the warhead is obtained.

What is described are specific examples of many possible variations on the same invention and are not intended in a limiting sense. The claimed invention can be practiced using other variations not specifically described above.

What is claimed is:

1. A warhead, comprising:

an inner core of explosive material comprising an explosive formulation having a heat of combustion from at least about 16 kcal/cc where said inner core of explosive material producing a detonation pressure when initiated at most about 10 kbar;

a central region comprising a central region explosive material where the central region is situated within the inner core of explosive material, wherein the central region explosive material is radially graded into the inner core of explosive material so that a formulation between the central region and the inner core of explosive material comprises a mixture of the central region explosive material and the inner core of explosive material, which increases in the percentage of central region explosive material radially approaching the central region and increases in percentage of the inner core of explosive material moving radially approaching the inner core moving radially away from the central region;

an outer annulus edge explosive material comprising an explosive formulation having a heat of detonation of at least 2.1 kcal/cc, a heat of combustion of at least about 5 kcal/cc and producing a detonation pressure when initiated of at least about 270 kbar, wherein the outer annulus edge explosive material is radially graded into the inner core of explosive material where the outer annulus edge explosive material is situated outside the inner core of explosive material so that a formulation between the outer annulus edge explosive material and the inner core of explosive material comprises a mixture of the outer annulus edge explosive material and the inner core of explosive material, which increases in the percentage of the outer annulus edge explosive material moving radially away from the inner core of explosive material and increases in percentage of the inner core explosive material moving radially towards the central region;

a warhead casing surrounding the outer annulus explosive material;

a first initiation system comprising a first booster explosive being positioned proximate to the central region, and a first detonator for initiating the first booster explosive; and, a second initiation system comprising a second booster explosive contacting the outer annulus edge explosive material and a detonator for initiating the second booster explosive.

2. The warhead of claim 1, wherein the second booster explosive comprises a position on a bottom side of the outer annulus edge of material and further comprising an absorbing material located between the first booster explosive and the second booster explosive wherein initiation of the first booster explosive does not result in initiation of the second booster explosive.

3. The warhead of claim 1, wherein the second booster explosive comprises a position on a top side of the outer annulus edge explosive material, and wherein a space is defined between the first booster explosive and the second booster explosive so that initiation of the first booster explosive deters an initiation of the second booster explosive.

4. The warhead of claim 1, wherein the outer annulus edge explosive material comprises more than 60% by volume of an explosive ingredient selected from at least one of HMX, RDX, and CL-20.

5. The warhead of claim 4, wherein the inner core of explosive material comprises at least about 60% by volume of metal particles, from about 5% to about 10% by volume of an ingredient selected from at least one of HMX, RDX, and CL-20, and from about 10% to about 25% by volume of a binder.

6. The warhead of claim 4, wherein the central region explosive material comprises more than 60% by volume of an explosive ingredient selected from at least one of PETN, RDX, and CL-20.

* * * * *